US005096128A

United States Patent [19]

Chang

[11] Patent Number: 5,096,128

[45] Date of Patent: Mar. 17, 1992

[54] GRINDING DEVICE FOR MEDICAL WASTE

[76] Inventor: Wu-Shun Chang, No. 131, O-Mei St., Taipei City, Taiwan

[21] Appl. No.: 657,443

[22] Filed: Feb. 19, 1991

[51] Int. Cl.[5] ..... B02C 18/12

[52] U.S. Cl. ..... 241/56; 241/69; 241/76; 241/99; 241/160; 241/239; 241/242

[58] Field of Search ..... 241/99, 73, 56, 69, 241/74, 78, 79.3, 154, 160, 239, 242, 76

[56] References Cited

U.S. PATENT DOCUMENTS

| | | | |
|---|---|---|---|
| 985,721 | 2/1911 | Bary | 241/69 |
| 4,061,276 | 12/1977 | Felker et al. | 241/69 |
| 4,605,173 | 8/1986 | Edmonds | 241/69 X |

FOREIGN PATENT DOCUMENTS

| | | | |
|---|---|---|---|
| 0223079 | 6/1985 | German Democratic Rep. | 241/160 |
| 62953 | 3/1949 | Netherlands | 241/69 |
| 196539 | 7/1967 | U.S.S.R. | 241/69 |
| 1234971 | 6/1971 | United Kingdom | 241/69 |

*Primary Examiner*—Mark Rosenbaum

*Attorney, Agent, or Firm*—Ladas & Parry

[57] ABSTRACT

A grinding device for medical waste includes a driving device, a hollow housing, a shaft vertically journalled in the housing driven by the driving device. A first bowl-shaped grinding container is coaxially provided in the housing with respect to the shaft, and includes a first wall having a plurality of through holes. A first cutting blade extends radially inward from the first wall. A second cutting blade is transversely provided above the first cutting blade and is adjustably mounted on the housing. The second cutting blade is cooperatively associated with the first cutting blade. A second bowl-shaped grinding container is coaxially provided in the housing, with respective to the shaft, around the first grinding container. The second grinding container has a second wall with a plurality of through holes. A third cutting blade extends downward from a radial inward flange on the second wall. A fourth cutting blade has a first end fixed to the housing, and a second end extending downward into the second grinding container and cooperatively associated with the third cutting blade.

3 Claims, 3 Drawing Sheets

GRINDING DEVICE FOR MEDICAL WASTE

FIELD OF THE INVENTION

This invention relates to a grinding device, more particularly to a grinding device for medical waste which includes two grinding containers to completely grind said waste.

DESCRIPTION OF RELATED ART

Referring to FIGS. 1 and 2, a conventional grinding device (A) includes a grinding container. The grinding container has a top open entrance (al) for medical waste, a closed bottom, and a surrounding side wall connected to the closed bottom. A first blade member (a4) extends inward from the surrounding side wall. A shaft (a3) driven by a rotor is vertically mounted in the grinding container. Three spaced second blade members (a2) respectively extend outward from the outer surface of the shaft (a3). A clearance is formed between the first blade member (a4) and each second blade member (a2) when the shaft (a3) is driven by the rotor and the second blade members (a2) pass the first blade (a4), so that the medical waste may be ground.

The medical waste is reduced to both large and small fragments during the grinding process. Because the larger fragments of medical waste fall into areas in which the grinding action is ineffective, said larger fragments cannot be further ground into requisite smaller fragments. These larger fragments of medical waste existent in the grinding container reduce the grinding action of the grinding device, and result in the breakdown of the grinding device.

SUMMARY OF THE INVENTION

Therefore, the object of this invention is to provide a grinding device for medical waste which includes two grinding containers to assure that the medical waste is completely ground into small fragments.

Accordingly, a grinding device for medical waste of this invention includes a driving means and a hollow housing. The hollow housing has a top entrance, a closed bottom and a surrounding side wall connected to the closed bottom and having an outlet near the closed bottom. A shaft vertically journalled in the housing has a top end extending inward from the closed bottom of the housing, and a bottom end passing through the closed bottom of the housing and connected to the driving means. A first bowl-shaped grinding container, which is provided in the housing beneath the top entrance of the housing, includes a first top open end accessed via the top entrance, and a first wall provided with a plurality of through holes. The first grinding container has a vertical axis coaxial with the axis of the shaft and is coaxially rotated by the shaft. A first cutting blade extends radially inward from the first wall.

A second cutting blade is transversely provided above the first cutting blade of the first grinding container and is adjustably mounted on the surrounding side wall of the housing to form an adjustable vertical clearance between the first cutting blade and the second cutting blade.

A second bowl-shaped grinding container is similarly coaxially provided in the housing around the first grinding container and is coaxially rotated by the shaft. The second container includes a second top open end, and a second wall surrounding the first wall and provided with a plurality of through holes. A flange extends radially inward from the second wall. A third cutting blade extends downward from the flange.

A fourth cutting blade includes a first end fixed to the surrounding side wall of the housing, and a second end extending downward into the second grinding container. An annular clearance is formed between the third cutting blade and the fourth cutting blade. A disc is horizontally mounted in the housing beneath the second grinding container and the outlet of the housing. The disc is connected to the shaft and is coaxially rotated by the same.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENTS

Figure 1:
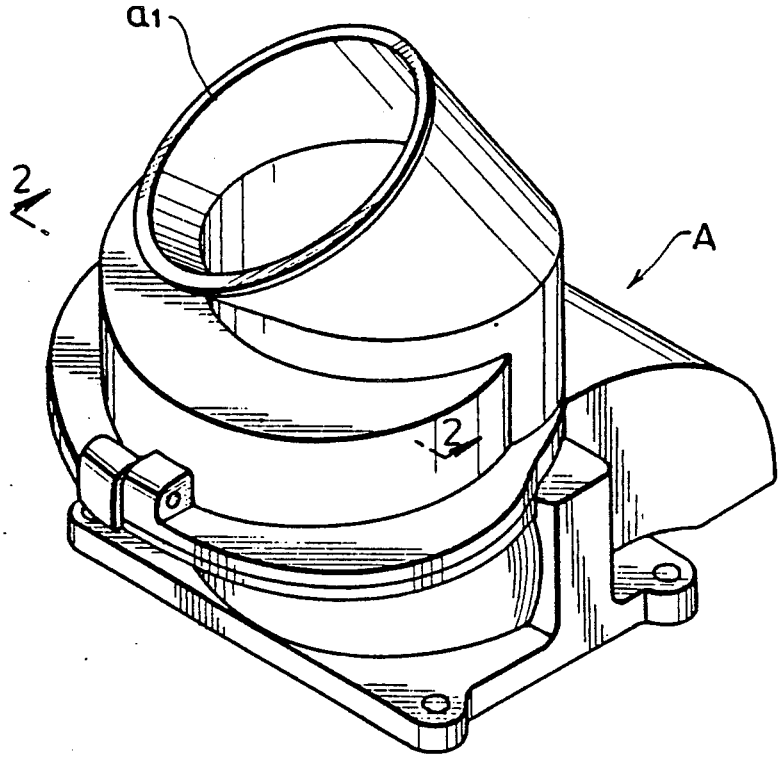
FIG.1 PRIOR ART
FIG. 1 is a perspective view of a conventional grinding device.
Figure 2:
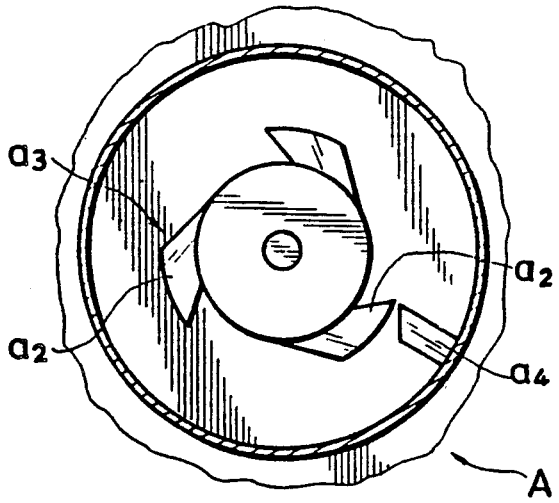
FIG.2 PRIOR ART
FIG. 2 is a sectional view taken along a line 2—2 of FIG. 1.
Figure 3:
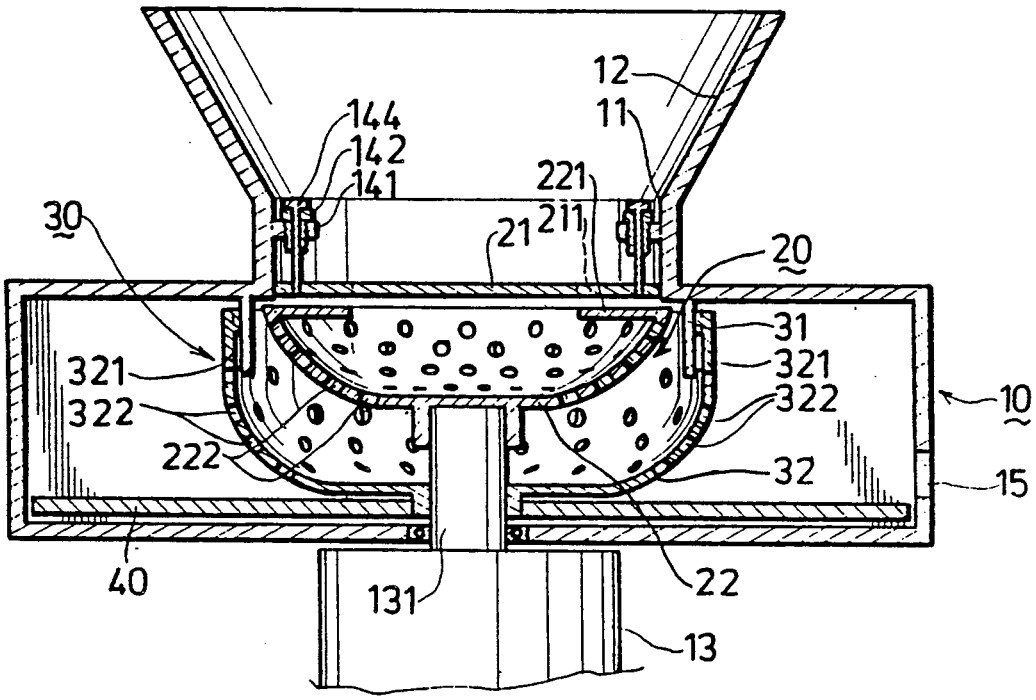
FIG. 3 is a sectional view of a first preferred embodiment of the grinding device of this invention.
Figure 4:
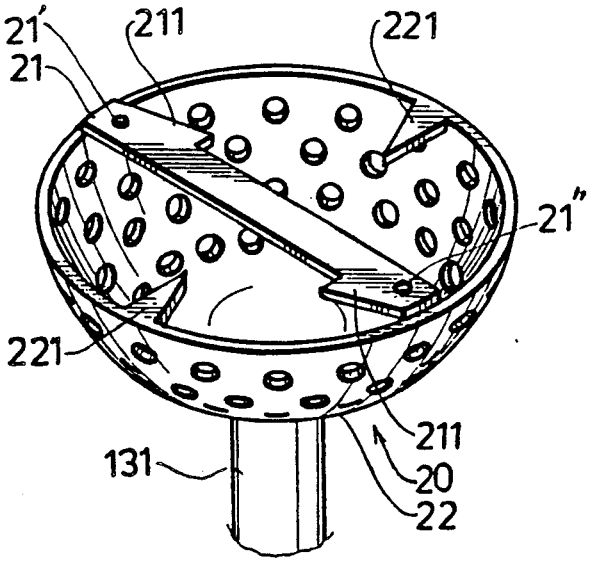
FIG. 4 is a schematic view of the first grinding container of the grinding device shown in FIG. 3.

Referring to FIGS. 3 and 4, a grinding device for medical waste of this invention includes a driving means 13, such as a motor, a hollow housing 10. The housing 10 includes a funnel-like top entrance 12 for medical waste, a closed bottom, and a surrounding side wall connected to the closed bottom and having an outlet 15 adjacent to the closed bottom. The top entrance 12 has a neck portion. A shaft 131 includes a top end extending inwards from the closed bottom of the housing 10, and a bottom end journaled on the closed bottom of the housing 10 and connected to the driving means 13.

A first bowl-shaped grinding container 20 is provided in the housing 10 beneath the top entrance 12 of the housing 10. The first grinding container 20 receives and grinds the medical waste and includes a first top open end accessed via the top entrance 12, and a first wall 22 provided with a plurality of through holes 222. The first grinding container 20 has a vertical axis coaxial with the axis of the shaft 131, and is coaxially rotated by the same. Two opposed first wedge-shaped cutting blades 221 radially extend inward from the top peripheral edge of the first wall 22 of the first container 20.

Two opposed mounting plates 141 are fixed to the neck portion 11 of the top entrance 12. Each of the mounting plates 141 includes a screw seat 142 fixed thereon, and an adjustment screw 144 extending downward through the screw seat 142. A second oblongated cutting blade 21 is transversely provided above the first cutting blades 221 of the first container 20, and is adjustably mounted on the housing 10 at two ends, 21' and 21", thereof by the adjustment screws 144. The second cutting blade 21 has two opposed cutting edges 211 respectively formed at the two opposed ends 21' and 21". An adjustable vertical clearance is thus formed between the first cutting blades 221 and the second cutting blade 21. A second bowl-shaped grinding container 30 is similarly coaxially provided in the housing 10 around the first grinding container 20. The second grinding container 30 is coaxially rotated by the shaft 131. The second grinding container 30 has a second top open end, and a second wall 32 surrounding the first wall 22 and provided with a plurality of through holes 322. A flange extends radially inward from the top edge of the second wall 32. Two opposed third oblongated cutting blades 321 respectively extend downward from the flange.

Two fourth oblong-like cutting blades 31 are oppositely provided in the housing 10. Each of the fourth oblongated cutting blades 31 includes a first end fixed to the surrounding side wall of the housing 10, and a second end extending downward into the second grinding container 30. An annular clearance is formed between the third cutting blades 321 and the fourth cutting blades 31.

A disc 40 is horizontally mounted on the housing 10 beneath the second grinding container 30 and the outlet 15 of the housing 10. The disc 40 is connected to the shaft 131 and is coaxially rotated by the same.

When the shaft 131 is rotated by the driving means 13, the first container 20, the second container 30, and the disc 40 are coaxially rotated at the same time. Medical waste poured into the top entrance 12 of the housing 10, is received and ground in the first container 20. During the grinding operation, larger fragments of medical waste are centrifugally forced to the upper portion of the first wall 22 of the first grinding container 20, and are further ground by the first cutting blades 221 and the second cutting blade 21. Smaller fragments of medical waste are forced into the second grinding container 30 through the through holes 222 of the first wall 22. The fragments received by the second grinding container 30 are further ground, in the same manner as in the first grinding container 20, by the third cutting blades 321 and the fourth cutting blades 31. Ground medical waste is forced out of the second grinding container 30 via the through holes 322 of the second wall 32, and onto the disc 40. Ground medical waste is finally discharged from the disc 40 through the outlet 15 by centrifugal force.

Figure 5:
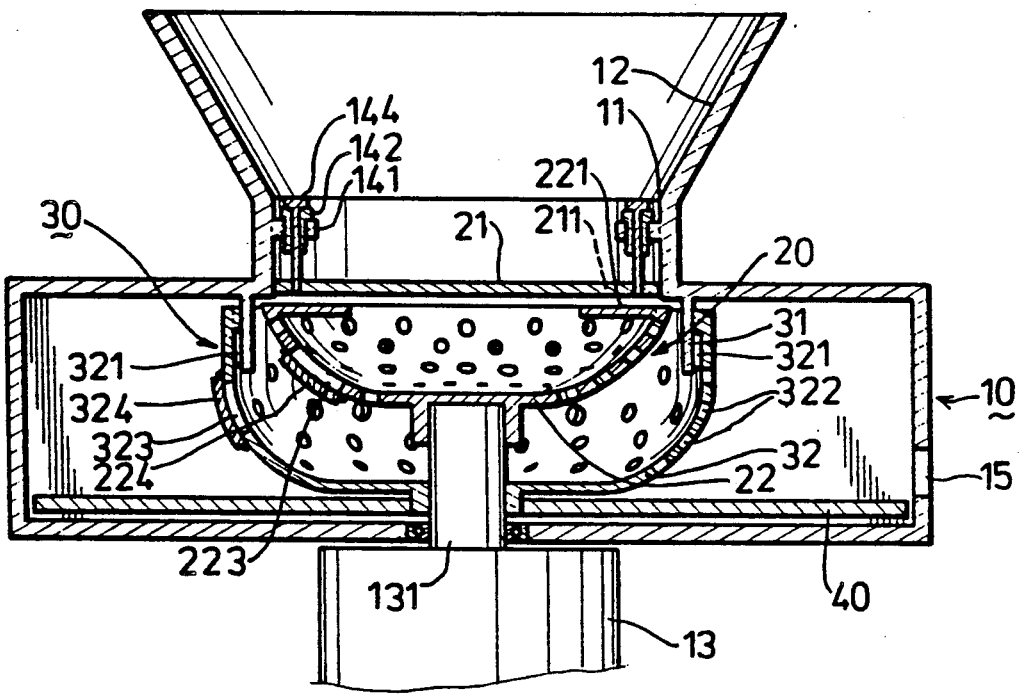
FIG. 5 is a sectional view of a second preferred embodiment of the grinding device of this invention.

A second preferred embodiment of the grinding device of this invention is substantially similar to the first preferred embodiment and is shown in FIG. 5. The shaft 13 is driven by the driving means 131 and is rotated in the clockwise direction. The first wall 22 of the first container 20 has a first opening 223, and a first cover 224 for the first opening 223. The first cover 224 has a rotatable leading end pivotally connected to the first wall 22 near the first opening 223. The second wall 32 of the second container 30 has a second opening 323, and a second cover 324 with a rotatable leading end pivotally connected to the second wall 32 near the second opening 323 to cover the same.

Sometimes, medical waste ground in the first container 20 or second container 30 includes bigger fragments, such as metal waste, which are not ground into the requisite fragment size to pass through the respective through holes 222 or 322, and are collected in the first and second containers 20 and 30. Under such conditions, the shaft 131 can be anti-clockwise rotated by the driving means 13, to correspondingly rotate the first container 20, the second container 30, and the disc 40 in the anti-clockwise direction. The first cover 224 and the second cover 324 are opened, and the bigger metal fragments in the first and second containers 20 and 30 are removed from the housing 10 via the first and second openings 223 and 224, and the outlet 15 by action of the centrifugal force.

It is thus shown that the medical waste is completely ground into small fragments by the two grinding containers in the grinding device of this invention. Metal medical wastes which are not ground into small fragments can be also sorted, collected, and disposed.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A grinding device for medical waste comprising: a driving means;

a hollow housing including a top entrance, a closed bottom, a surrounding side wall connected to said closed bottom and having an outlet near said bottom;

a shaft journaled in said housing and having a top end extending inwards from said closed bottom of said housing, and a bottom end passing through said closed bottom of said housing and being connected to said driving means;

a first bowl-shaped grinding container provided in said housing beneath said top entrance of said housing, said first grinding container including a first top open end opening to said top entrance, and a first wall provided with a plurality of through holes, said first grinding container having a vertical axis coaxial with the axis of said shaft so that said first grinding container may be coaxially rotated by said shaft, and a first cutting blade extending radially inward from said first wall;

a second cutting blade transversely provided above said first cutting blade of said first grinding container, said second cutting blade being adjustably mounted on said surrounding side wall of said housing to form an adjustable vertical clearance between said first cutting blade and said second cutting blade;

a second bowl-shaped grinding container provided in said housing around said first grinding container and coaxially rotated by said shaft, said second container including a second top open end, a second wall surrounding said first wall and having a plurality of through holes thereon, a flange extending radially inward from said second wall, and a third cutting blade extending downward from said flange;

a fourth cutting blade including a first end fixed to said surrounding side wall of said housing, and a second end extending downward into said second grinding container to form an annular clearance between said third cutting blade and said fourth cutting blade; and a disc horizontally mounted in said housing beneath said second grinding container and said outlet of said housing, said disc being connected to said shaft and coaxially rotated by the same.

2. A fragmentation device as claimed in claim 1, wherein said second cutting blade is substantially oblongated and has two opposed cutting edges respectively formed on two ends thereof.

3. A fragmentation device as claimed in claim 1, wherein said first wall includes a first opening, and a first cover pivotally connected thereto near said first opening, and said second wall has a second opening, and a second cover pivotally connected to said second wall near said second opening.

* * * * *